US009410314B1

(12) United States Patent
Kadosh

(10) Patent No.: US 9,410,314 B1
(45) Date of Patent: Aug. 9, 2016

(54) MODULAR FLOODWALL CONSTRUCTION ELEMENTS

(71) Applicant: Yoav Kadosh, Haifa (IL)

(72) Inventor: Yoav Kadosh, Haifa (IL)

( * ) Notice: Subject to any disclaimer, the term of this patent is extended or adjusted under 35 U.S.C. 154(b) by 0 days.

(21) Appl. No.: 14/880,232

(22) Filed: Oct. 11, 2015

(51) Int. Cl.

| | |
|---|---|
| ***E02B 3/14*** | (2006.01) |
| ***E04B 2/44*** | (2006.01) |
| ***E04C 1/00*** | (2006.01) |
| ***E04B 2/02*** | (2006.01) |
| ***E04B 2/46*** | (2006.01) |
| ***E02B 8/00*** | (2006.01) |

(52) U.S. Cl.
CPC ... *E04B 2/44* (2013.01); *E02B 3/14* (2013.01); *E02B 8/00* (2013.01); *E04B 2/02* (2013.01); *E04B 2/46* (2013.01); *E04C 1/00* (2013.01); *E04B 2002/0297* (2013.01)

(58) Field of Classification Search
CPC ..... E04B 2/02; E04B 2/44; E04B 2/46; E04B 2002/0297; E02B 3/14; E02B 8/00; E01C 1/00
USPC ..... 52/439, 604, 606, DIG. 2; 405/284; D25/122
See application file for complete search history.

(56) References Cited

U.S. PATENT DOCUMENTS 834,950 A * 11/1906 Van Wie ..... E04F 15/04 446/124
1,894,605 A * 1/1933 Wright ..... A63H 33/04 446/122
4,083,190 A * 4/1978 Pey ..... E02B 3/129 404/41
4,441,298 A * 4/1984 Limousin ..... A63H 33/088 52/592.2
4,481,155 A * 11/1984 Frohwerk ..... B01J 19/32 261/94
4,651,485 A * 3/1987 Osborne ..... E04B 2/08 52/220.2
4,990,116 A * 2/1991 Chen ..... A63H 33/084 446/124
5,154,542 A * 10/1992 Klenert ..... E02D 17/18 405/284
5,273,477 A * 12/1993 Adams, Jr. ..... A63H 33/08 446/108
5,803,660 A * 9/1998 Warren ..... F01B 1/12 119/221
8,567,149 B2 * 10/2013 Kuzmin ..... A63H 33/08 52/592.1

FOREIGN PATENT DOCUMENTS

AU 496022 * 8/1977 ..... E04C 1/10

* cited by examiner

*Primary Examiner* — Michael Safavi
(74) *Attorney, Agent, or Firm* — Edward Langer, Adv. & Patent Attorney

(57) ABSTRACT

A system of modular, hollow interlocking elements which are made of tough flexible lightweight material, which can be connected in order to form a stable continuous, multi-directional structure, requiring no adhesives or other stabilizing materials and can be filled with any required filling materials such as sand or locally available filling materials for use as low shaped dams, a flood protection barrier or in any need to change the course of water or fluid. The various modular elements that make up the structure can be provided by shapes having four, five, six, seven or eight walls, all identical in function, enabling quick construction of a water flood barrier, or an acoustic insulation wall, with easy adjustment of its height, length or width.

16 Claims, 8 Drawing Sheets

MODULAR FLOODWALL CONSTRUCTION ELEMENTS

FIELD OF THE INVENTION

The present invention relates to construction materials and methods, and more particularly, to a multi-directional, interlocking, hollow modular construction element having flexibility, designed for filling with material such that the active vertical and horizontal pressure of the filling material is utilized to develop a complete closure between adjoining elements.

BACKGROUND OF THE INVENTION

In building of load-bearing constructions involving filling materials, the active vertical and horizontal pressure of the filling materials is taken into consideration. The active pressure exerted by the filling material is proportional to the height of the filled element.

In fly previous patent (U.S. Pat. No. 6,477,814) the stated goal was to "absorb large horizontal or vertical pressure and thus restrain or minimize the effects of active pressure". In order to do so the patent uses " . . . rigid hollow polygonal framing elements . . . ". However, with this approach, water could possibly seep through the hollow cavities comprising the spaces formed between the adjoining rigid elements in this construction, without having anything to stop this and thus, a wall formed by these elements might not function effectively as a water barrier.

Therefore, it would be desirable to provide a floodwall construction using construction elements which form a water barrier.

SUMMARY OF THE INVENTION

Accordingly it is an object of the present invention to provide interlocking elements that can be connected along each face to form a stable, continuous, multi-directional structure, requiring no cement or other adhesive material.

In the present invention, the building elements and the hollow cavities comprising the spaces formed between adjacent building elements are filled with any required filling materials, and this combined with the closing of the flexible element walls against adjacent walls becomes an insurmountable barrier to water.

The new fast modular method to restrain floods is different from my previous patent (U.S. Pat. No. 6,477,814) since there, the stated goal was to "absorb large horizontal or vertical pressure and thus restrain or minimize the effects of active pressure using rigid hollow polygonal framing elements . . . " while in this present invention the main goal is to utilize the active pressure in order to create a complete closure between the construction elements. Thus, the present invention uses flexible material for the construction elements (unlike the rigid elements in U.S. Pat. No. 6,477,814), which enables use of the active pressure as a means to achieve complete closure between the construction elements.

It is a further object of the present invention to provide flexible elements which are hollow and can be filled with any required materials.

It is a further object of the present invention to provide interlocking elements which can take advantage of horizontal pressure arising from the vertical filling material and to use it in order to achieve better closure of the designed system.

In accordance with a preferred embodiment of the present invention, there is provided a system of modular interlocking elements comprising a plurality of flexible, hollow, polygonal elements having vertical faces, a first portion of said polygonal elements provided as base elements arranged as a base layer. A second portion of said polygonal elements are provided as interlocking elements arranged as an intermediate layer above said base layer, and a third portion of said polygonal elements are provided as interlocking elements arranged as an upper layer above said intermediate layer. The interlocking elements in said intermediate layer are formed with a vertical slit in all of said vertical faces, and said interlocking elements in said upper layer are formed with vertical slits in at least two of said vertical faces, such that said at least two vertical slits of each of said intermediate layer elements engage said base elements, and said at least two vertical slits of each of said upper layer elements engage said intermediate layer elements, such that said base, upper and intermediate layers provide a mortarless, multidirectional load-bearing construction.

The flexible interlocking elements form a continuous structure which utilizes the active pressure exerted by any filling materials.

Thus, the load exerted on the flexible element wall develops forces which are used to close the space between the adjacent elements as these forces are spread horizontally to the surrounding foundation.

A feature of the present invention is to provide modular elements for use in construction of structures in which active pressure is a factor, such as a water flood protector, causing change in the direction of water flow, enabling construction of small dams, and structures used for personal military position protection (such as an acoustic wall), etc.

A further advantage of the present invention is that due to their shape, the inventive construction elements form hollow cavities comprising the spaces formed between adjacent building elements that are filled with filling materials that completely prevent water passage therethrough.

A further advantage of the present invention is that the interlocking structure of the elements enables construction in all directions, permitting even load distribution and adding to the load bearing capacity of the entire construction.

A further advantage of the present invention is the ability to add elements to the width of the intended structure when it is necessary to strengthen certain areas against water pressure or for any other reason.

BRIEF DESCRIPTION OF THE DRAWINGS

For a better understanding of the invention with regard to the embodiments thereof, references is made to the accompanying drawings, in which like numerals designate corresponding sections or elements throughout, and in which.

DETAILED DESCRIPTION OF THE PREFERRED EMBODIMENTS

Figure 1:
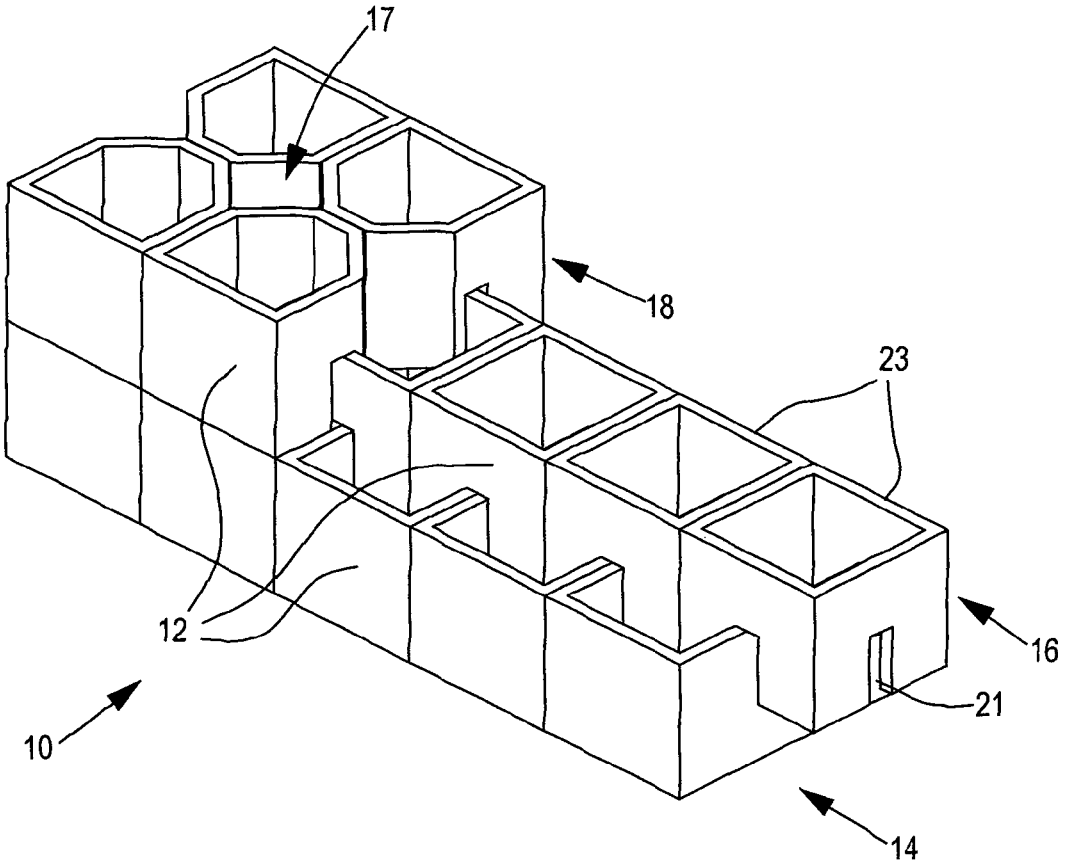
FIG. 1 is a general perspective view of three layers of elements with the intermediate layer elements that connect each element and the layers to each other.

FIG. 1 shows a perspective view of a partial assembly of a construction 10, such as a floodwall, using a series of modular elements 12. This variation of construction 10 has three layers, a base layer 14, an intermediate layer 16 and an upper layer 18. A hollow cavity 17 comprising the space between adjacent elements 12 is formed by the construction.

Figure 7:
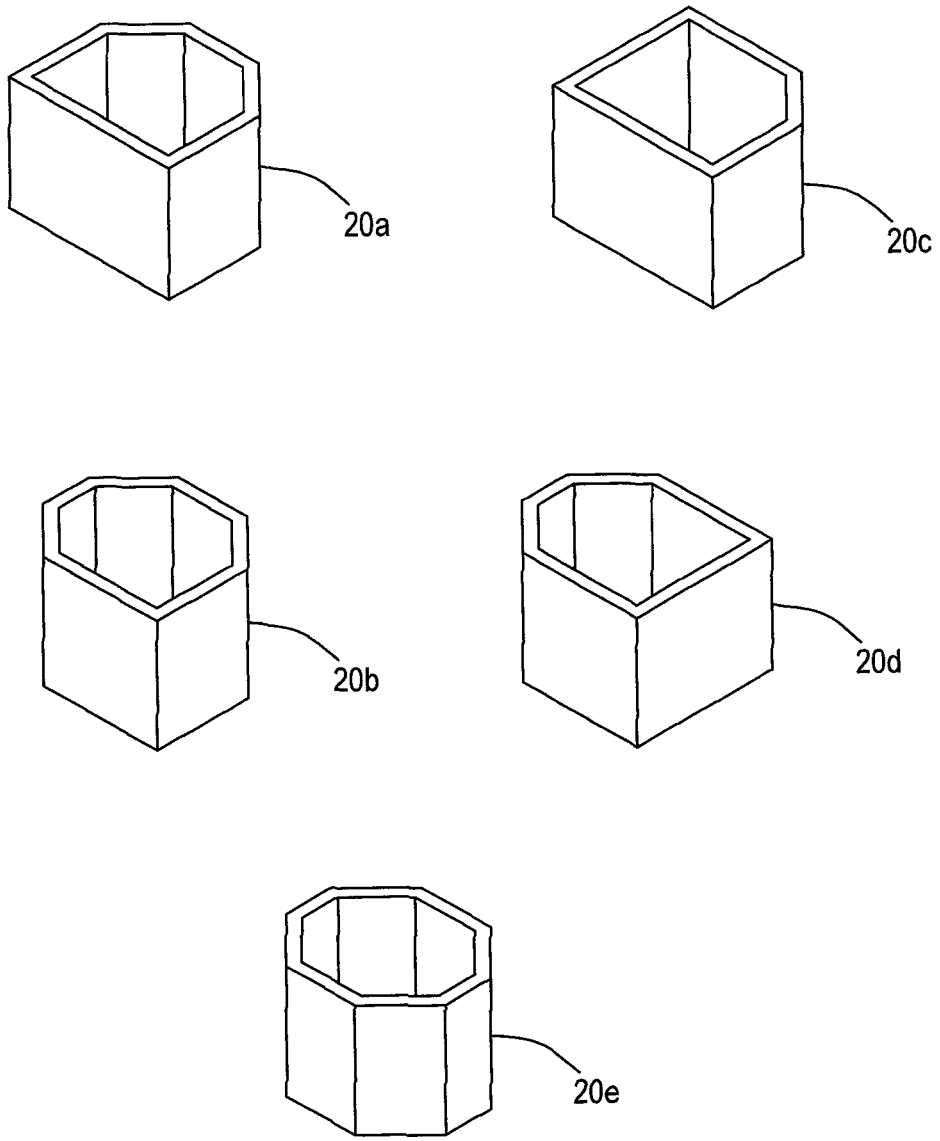
FIG. 7 is a perspective view of the base layer elements.
Figure 8:
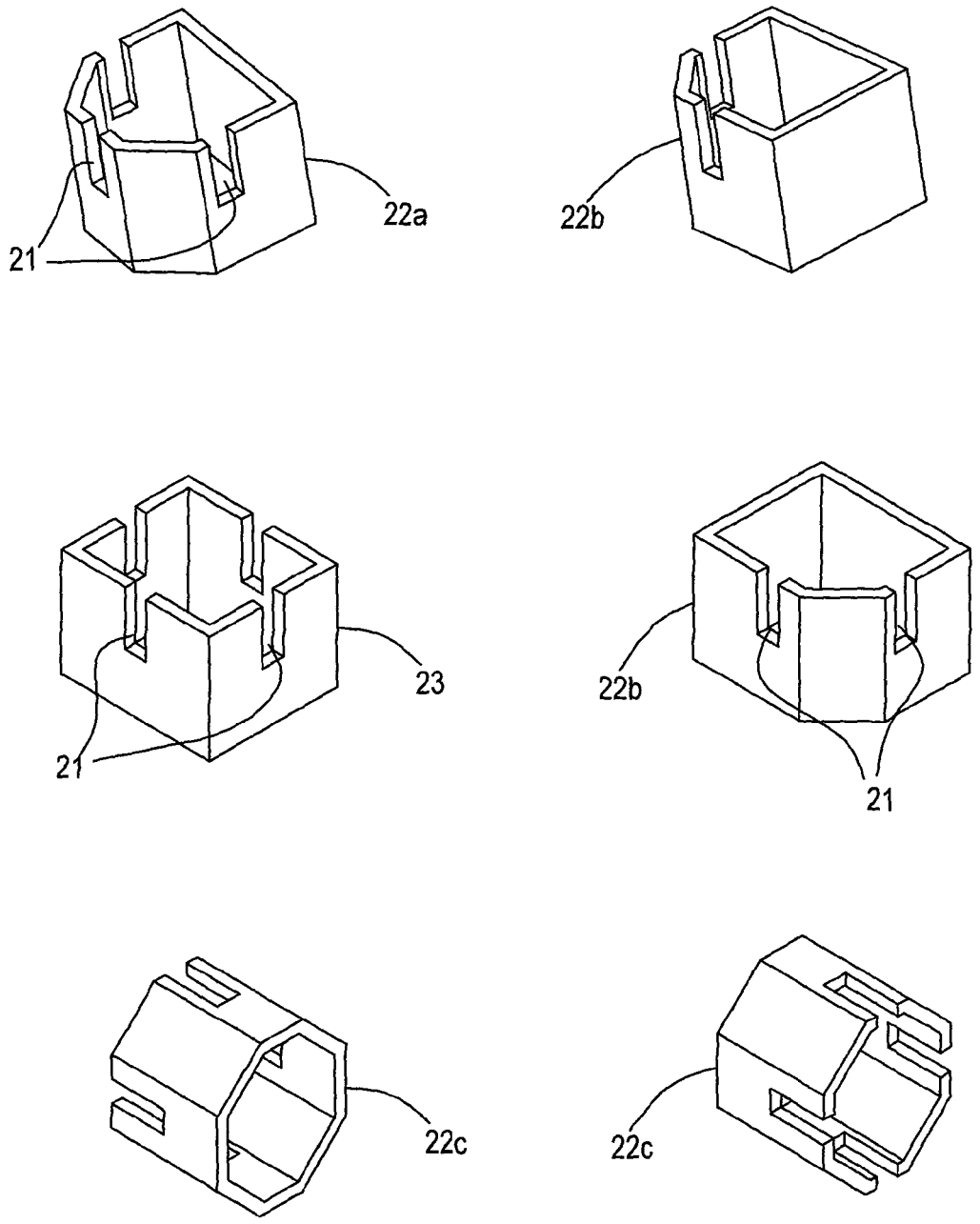
FIG. 8 is a perspective view of the intermediate and upper layer elements.

All the variations of elements 12 are shown individually in FIGS. 7 and 8, and are denoted as elements 20*a*, 20*b*, 20*c*, 20*d*, 20*e*, 22*a*, 22*b*, 22*c*, and 23, and they all are hollow, having only vertical faces, with no upper or lower horizontal face.

The framing elements that form the base layer 14 of construction 10 have five, six, seven or eight smooth vertical faces as can be seen in FIG. 7 using the polygonal shapes of 20*a*, 20*b*, 20*c*, 20*d*, and 20*e* with no vertical slits.

In assembling construction 10, the elements 20*a*, 20*b*, 20*c*, 20*d*, 20*e* of base layer 14 are first arranged in the required formation as can be seen in FIGS. 2A-B and FIGS. 3A-B.

As per FIG. 8, the alternative embodiment of the modular elements having vertical slits 21 formed on the vertical faces of elements 22*a*, 22*b*, 22*c*, and 23 are shown. The slits 21 are formed extending upwards from mid-point of the lower face of the element, for a length one-half the height of the wall. The number of vertical slits 21 formed on the vertical faces of elements 22*a*, 22*b*, 22*c*, and 23 may differ as described further below. Element 23 will always have four slits as its main function is to hold together the elements constructing the different layers. The width of the slits 21 are always equivalent to double the thickness of the walls of the elements, to enable the walls of the lower elements to come through up to half the height of the element's face. Vertical slits 21 are designed to enable a staggered interlocking arrangement of the elements that construct the layers.

Each element 23 has four slits 21 and is used for placement over arrangements of the base layer, since its function is to hold the elements tightly together for assembling the construction. Elements 23 hold together the elements in the base layer 14 and provide the intermediate layer 16 for connection to the elements of the upper layer 18. Elements 23 which are used in intermediate layer 16 do not extend to the outer perimeter of construction 10. Element 23 is also used in the interior of upper layer 18 in which case element 23 will be surrounded by elements 22*a*, 22*b*, 22*c*, 20*a*, 20*b*, 20*c*, 20*d*, or 20*e* located in the outer perimeter.

Figure 2A:
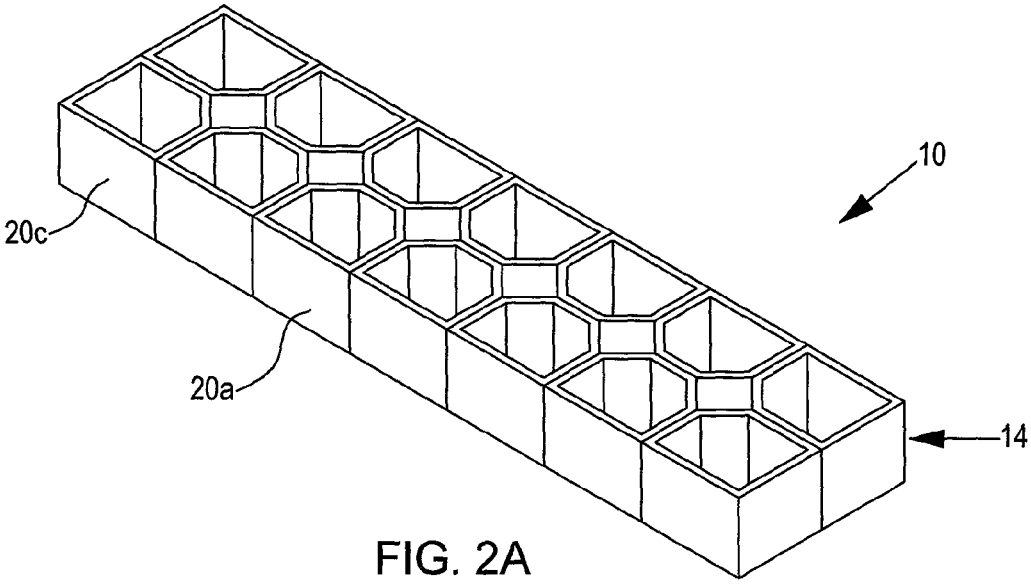
FIGS. 2A-C are respectively, perspective, top and elemental views of the modular elements forming a base layer with two rows.
Figure 2B:
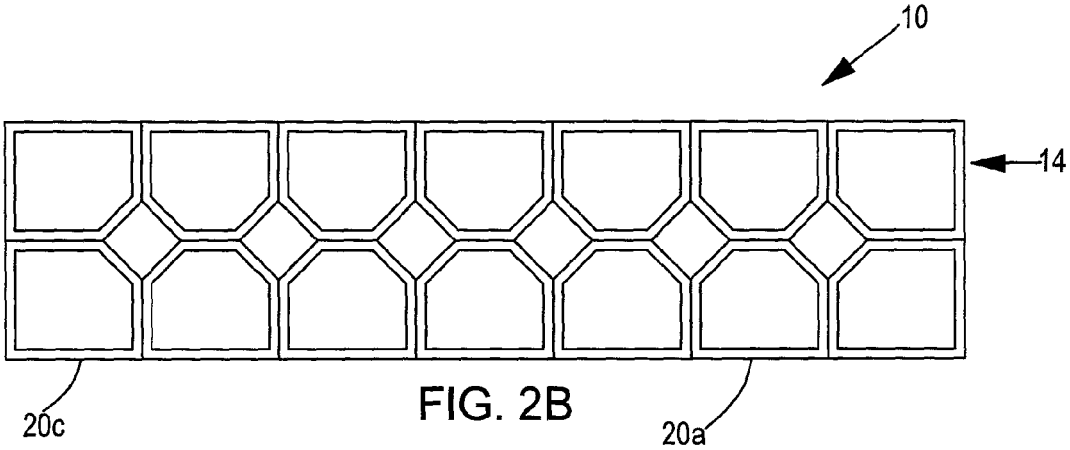
Figure 2C:
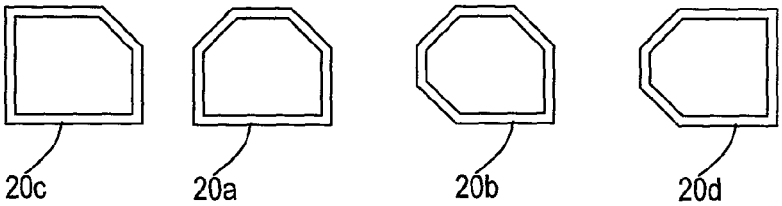
Figure 3A:
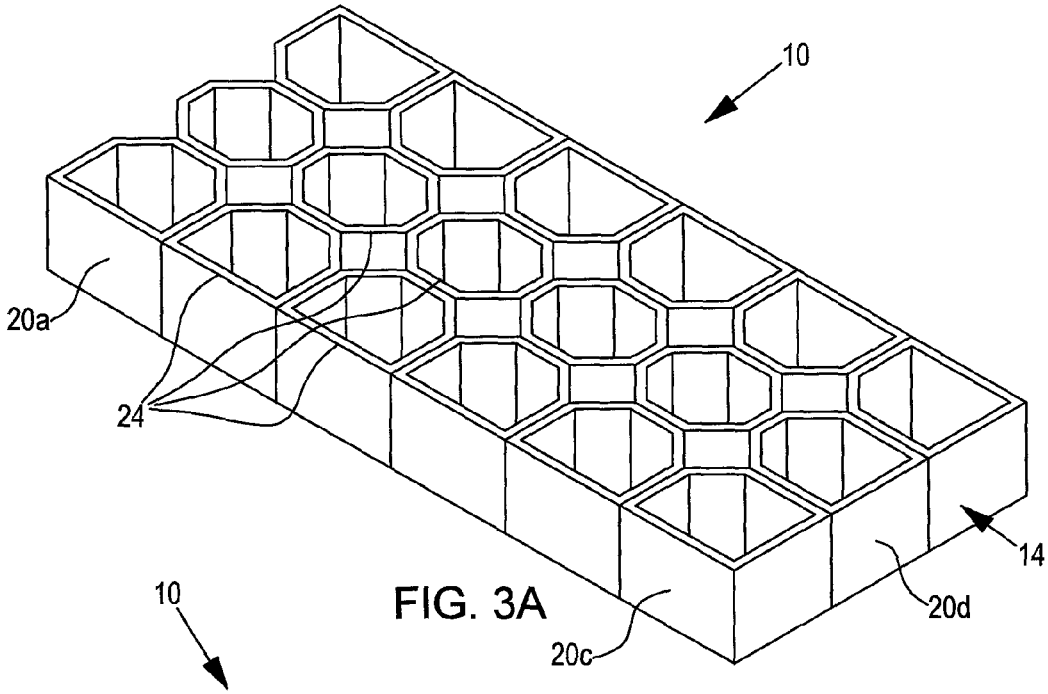
FIGS. 3A-C are respectively, perspective, top and elemental views of the modular elements forming a base layer with three rows.
Figure 3B:
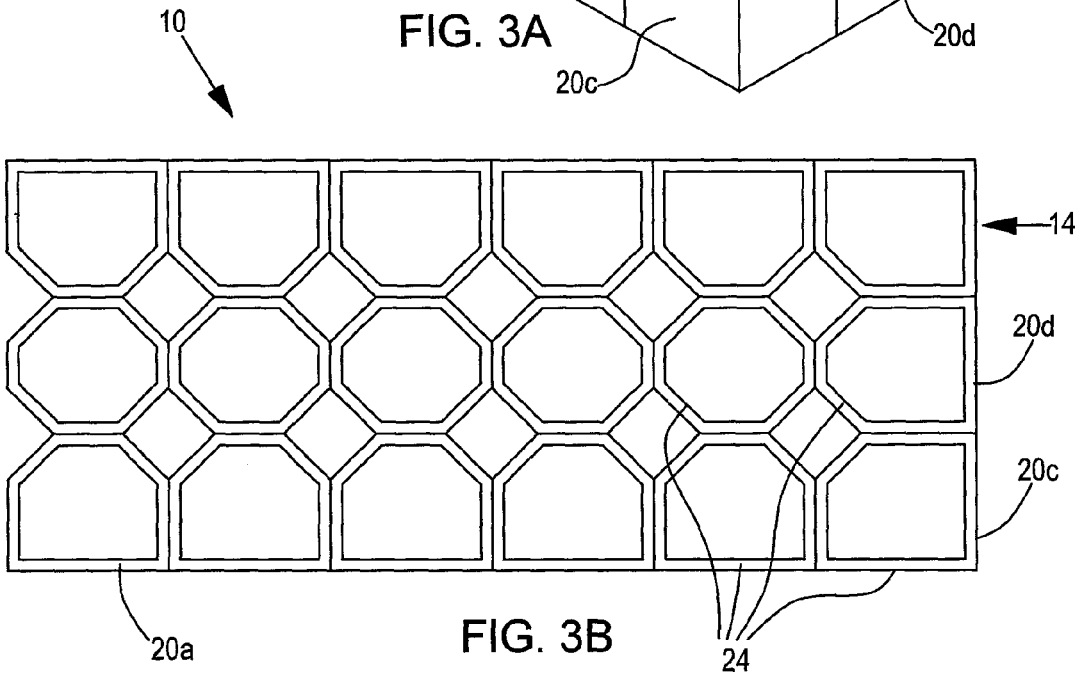
Figure 3C:
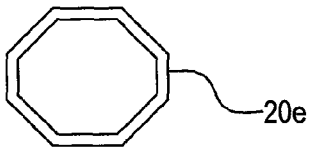
Figure 4A:
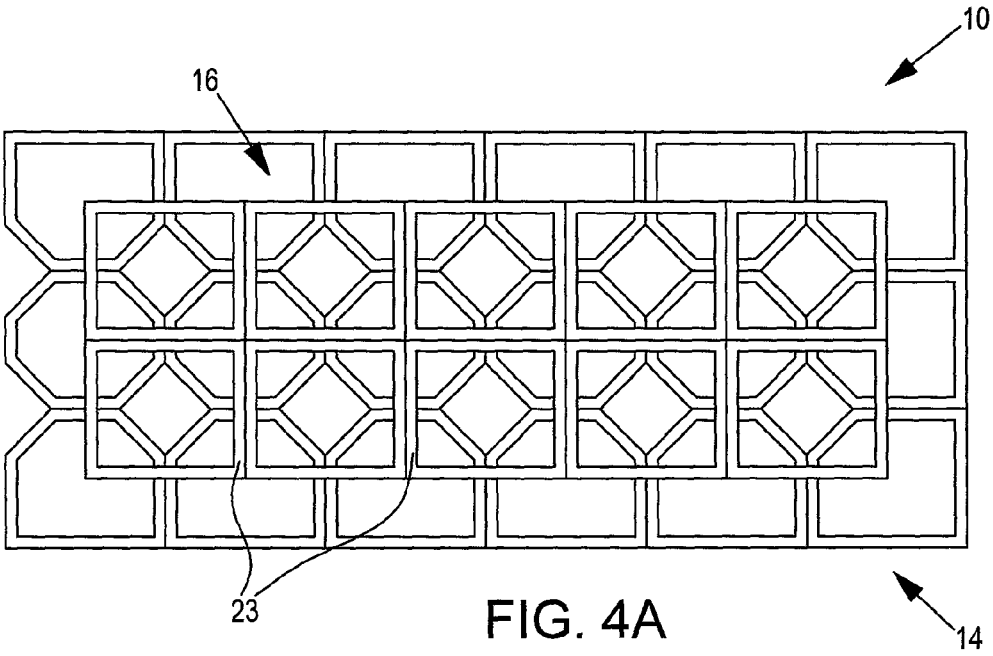
FIGS. 4A-B are respectively, top views of alternative constructions of the modular elements with three rows with the intermediate layer.
Figure 4B:
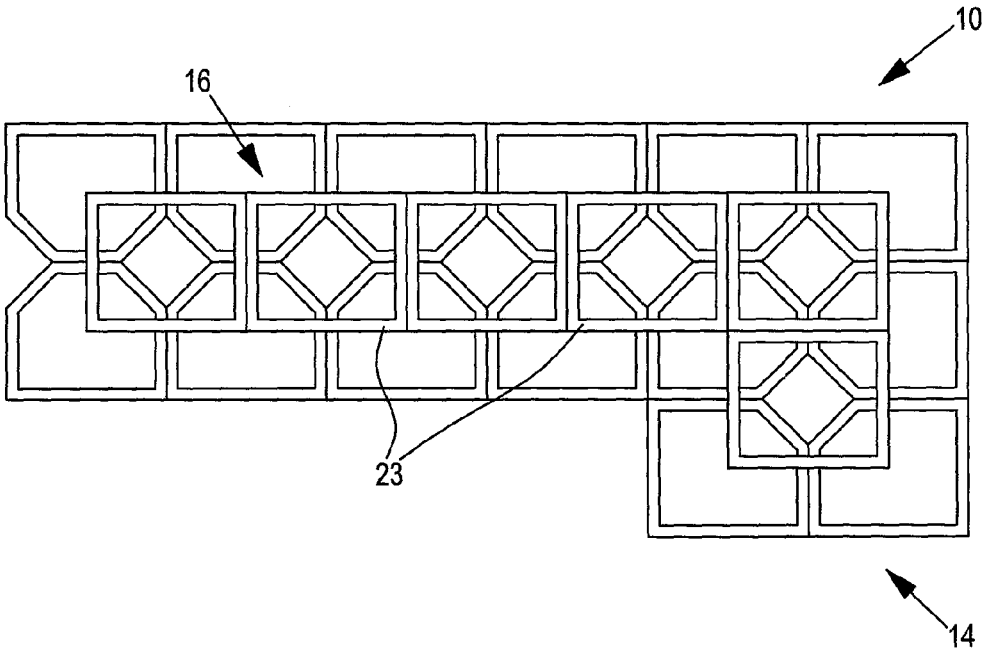

FIGS. 4A and 4B show construction 10 in which element 23 is arranged upon base layer 14 shown in FIGS. 2A-B and FIGS. 3A-B. Elements 23 each have a slit 21 (see FIG. 6) in each of their four vertical faces. Each element 23 is placed over a group of four elements 24 arranged so as to form a square thus, each slit 21 holds together a side of each of two adjacent ones of four elements 24 and four elements 24 of base layer 14 are held within each intermediate layer element 23.

Figure 5A:
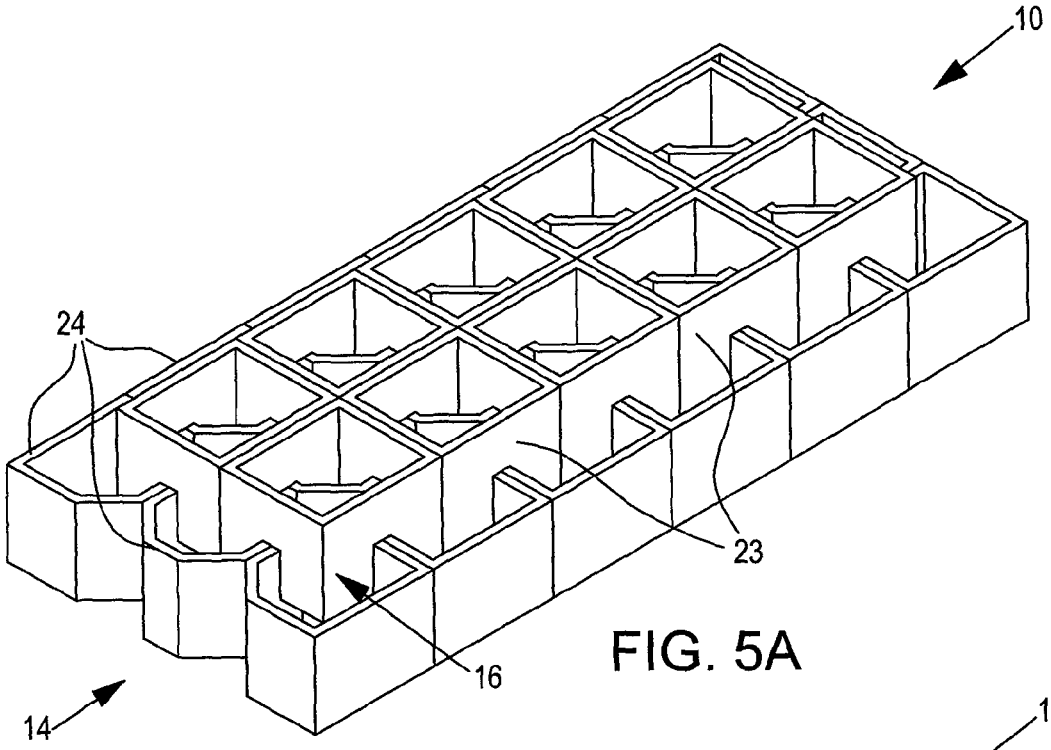
FIGS. 5A-B are respectively, perspective views of the modular elements with three rows forming a base layer and intermediate layer, and three rows forming base, intermediate and upper layers.
Figure 5B:
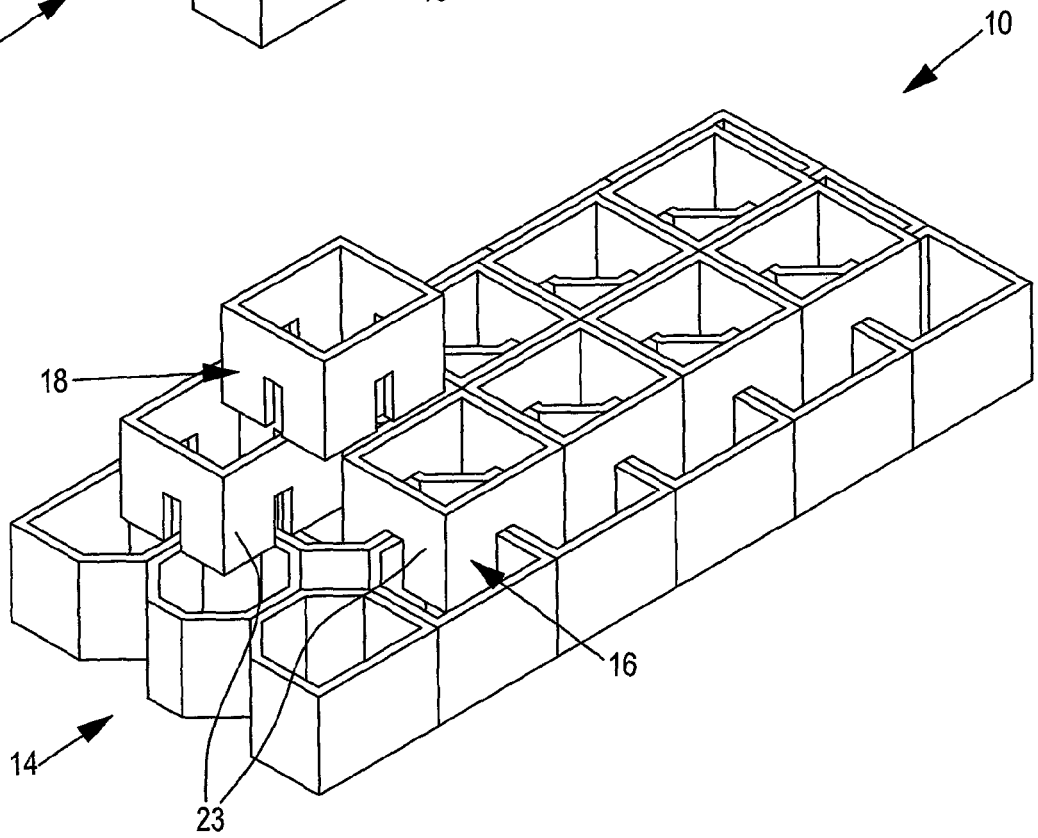

FIGS. 5A-B are respectively, perspective views of the modular elements 23 with three rows forming a base layer 14 and intermediate layer 16, and three rows forming base layer 14, intermediate layer 16 and upper layer 18.

Figure 6:
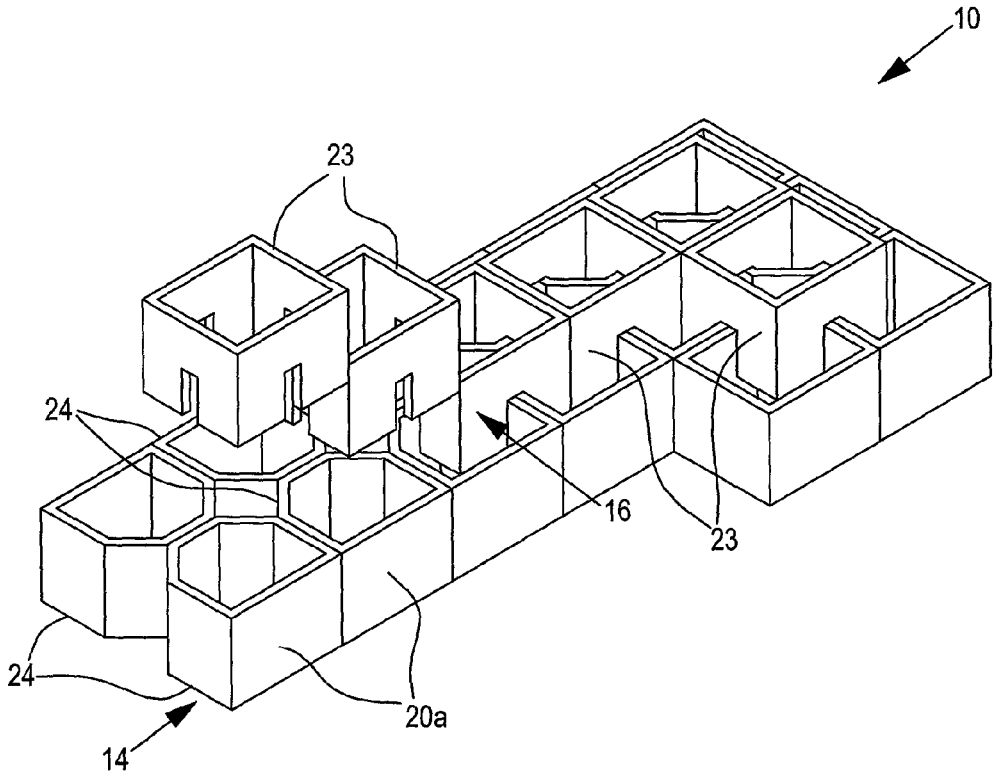
FIG. 6 is a perspective view of the modular elements with two rows and a partial third row, forming base and intermediate layers.

FIG. 6 is a perspective view of the modular elements with two rows and a partial third row, forming base layer 14 and intermediate layer 16.

Referring now to FIG. 7 and FIG. 8, the individual modular elements are further illustrated.

FIG. 7 shows modular elements without slits, these elements comprise the base layer 14 with width of two rows (FIGS. 2A-B) or three rows (FIGS. 3A-B).

When only two rows in width are needed as shown in FIGS. 2A-B there will be need of elements 20*a* and 20*d* to construct the structure. If three rows in width or more are needed, additional modular elements 20*b*, 20*c* and 20*e* will be used.

FIG. 8 shows modular elements with slits 21 that will have to be used in the intermediate layer and higher.

Element 23 in FIG. 8 shows a modular element having four slits 21 each of which engages the adjacent walls of each of two lower level elements and thus holds four elements together.

FIG. 5B shows how element 23 with four slits holds four elements of base layer 14 at a time, and enables construction of an unlimited structure with two, three or more rows. A second row of elements will have similar elements like the ones of the first row but, will engage slits of element 23 to connect the element to the structure. Elements 22*b* with two slits will be in the corner of the structure (not shown) and element 22*a* with three slits will run in the outer side of the structure (not shown) while element 22*c* with four slits will keep on being in the middle of three rows structure (not shown).

The variations in the number of slits and elements enables the various constructions to be formed having a smooth, continuous, outer surface as all outward facing elements have a smooth face and are thus able to divert water flow and protect against water floods.

The hollow, flexible elements that make up the structure enables construction 10 to be filled after assembly with filling material, and to use the active pressure generated by the filling material on the flexible walls of side-by-side elements to close the walls against each other on one side, and according to their shape, form hollow cavities 17 comprising the spaces formed between adjacent building elements that are also filled with filling materials that ensure the prevention of water penetration.

The interlocking arrangement of the elements results in a stable construction, without need for any mortar or stabilized material, thus increasing the speed and efficiency in which the construction can be erected which is the main goal in case of floods or any other quick need for defense, including an acoustic insulation wall.

Having described the invention with regard to certain specific embodiments thereof, it is to be understood that the description is not meant as a limitation, since further modifications will now become apparent to those skilled in the art, and it is intended to cover such modifications as fall within the appended claims.

The invention claimed is:

1. A system of modular, hollow interlocking framing elements made of flexible lightweight material and capable of receiving filling materials and utilizing the active pressure generated thereby, said system comprising:

a plurality of flexible, hollow polygonal framing elements each having a plurality of only vertical faces, joined at their edges, a first portion of said polygonal elements with no slits provided as a base layer, a second portion of said polygonal elements with four slits provided as interlocking intermediate elements arranged as an intermediate layer above said base layer, a third portion of said polygonal elements provided as interlocking elements arranged as an upper layer above said intermediate layer, said interlocking elements in said intermediate layer being formed with a single vertical slit extending upwards from the mid-point of the lower edge of each of said vertical faces, said vertical slit having height equal to half the height of said vertical face, and width equivalent to the total thickness of two of the walls of said base layer elements to be inserted therein, said interlocking elements in said upper layer being formed with a single vertical slit extending upwards from the mid-point of the lower edge of at least two of said vertical faces, said vertical slit having height equal to half the height of said vertical face, and width equivalent to the total thickness of two of the walls of said intermediate layer elements to be inserted therein, such that each of said vertical slits formed in said vertical face of said intermediate layer elements engages said base elements at a horizontal mid-point of said vertical face of said base elements, and each of said vertical slits formed in said vertical faces of each of said upper layer elements engages said intermediate layer elements at a horizontal mid-point of said vertical face of said intermediate layer elements, such that said base layer elements are aligned with said upper layer elements to form a smooth, continuous outer surface, said base, upper and intermediate layer providing a staggered, mortarless, multidirectional load-bearing construction, said construction having hollow cavities comprising spaces formed between adjacent framing elements, said cavities also capable of receiving filling materials wherein said active pressure is utilized to seal adjacent edges of said interlocking elements against each other.

2. The system of claim 1 in which said upper layer elements include at least one smooth outer face to be arranged as an outer perimeter of said upper layer, such that said multidirectional load-bearing construction is formed with a smooth, continuous outer surface.

3. The system of claim 1 wherein said plurality of interlocking elements is formed with a vertical slit in each of two vertical faces.

4. The system of claim 1 wherein said plurality of interlocking elements is formed with a vertical slit in each of three vertical faces.

5. The system of claim 1 wherein said plurality of interlocking elements is formed with a vertical slit in each of four vertical faces.

6. The system of claim 1 for use in construction of a flood protection barrier.

7. The system of claim 1 for use in construction of a barrier to change the course of water or fluid.

8. The system of claim 1 for use in construction of rapid military field protection.

9. The system of claim 1 for use in construction to collect a pool of water.

10. The system of claim 1 for use in construction of an acoustic insulation wall.

11. A method of assembling modular, hollow interlocking framing elements made of flexible lightweight material and capable of receiving filling materials and utilizing the active pressure generated thereby, said method comprising:

providing a plurality of flexible, hollow polygonal framing elements each having a plurality of only vertical faces, joined at their edges, providing a first portion of said polygonal elements with no slits as a base layer, providing a second portion of said polygonal elements with four slits as interlocking intermediate elements, providing a third portion of said polygonal elements as interlocking elements in an upper layer, placing said second portion of said polygonal elements as an intermediate layer above said base layer, placing said third portion of said polygonal elements as said upper layer above said intermediate layer, said interlocking elements in said intermediate layer being formed with a single vertical slit extending upwards from the mid-point of the lower edge of each of said vertical faces, said vertical slit having height equal to half the height of said vertical face, and width equivalent to the total thickness of two of the walls of said base layer elements to be inserted therein, said interlocking elements in said upper layer being formed with a single vertical slit extending upwards from the mid-point of the lower edge of at least two of said vertical faces, said vertical slit having height equal to half the height of said vertical face, and width equivalent to the total thickness of two of the walls of said intermediate layer elements to be inserted therein, such that each of said vertical slits formed in said vertical face of said intermediate layer elements engages said base elements at a horizontal mid-point of said vertical face of said base elements, and each of said vertical slits formed in said vertical faces of each of said upper layer elements engages said intermediate layer elements at a horizontal mid-point of said vertical face of said intermediate layer elements, such that said base layer elements are aligned with said upper layer elements to form a smooth, continuous outer surface, said base, upper and intermediate layer providing a staggered, mortarless, multidirectional load-bearing construction, said construction having hollow cavities comprising spaces formed between adjacent framing elements, said cavities also capable of receiving filling materials, and filling said framing elements and said cavities with filling materials, wherein said active pressure is utilized to seal adjacent edges of said interlocking elements against each other.

12. The method of claim 11 for constructing a flood protection barrier.

13. The method of claim 11 for constructing a barrier to change the course of water or fluid.

14. The method of claim 11 for constructing rapid military field protection.

15. The method of claim 11 for constructing a pool to collect water.

16. The method of claim 11 for constructing an acoustic insulation wall.

* * * * *